US006964220B1

(12) United States Patent
Lavin

(10) Patent No.: US 6,964,220 B1
(45) Date of Patent: Nov. 15, 2005

(54) FLOATING BARREL HANDGUN METHOD OF RECOIL ELIMINATION

(76) Inventor: Walter M Lavin, 632 W. Glenwood Ave., P.O. Box 1362, West Wildwood, NJ (US) 08260

( * ) Notice: Subject to any disclaimer, the term of this patent is extended or adjusted under 35 U.S.C. 154(b) by 60 days.

(21) Appl. No.: 10/842,662

(22) Filed: May 10, 2004

(51) Int. Cl.[7] ..... F41A 3/00
(52) U.S. Cl. ..... 89/159; 89/1.7; 89/1.703; 42/10
(58) Field of Search ..... 89/161, 159, 1.7, 89/1.703, 1.704, 1.705, 1.706; 42/10, 1.06

(56) References Cited

U.S. PATENT DOCUMENTS

| | | | | |
|---|---|---|---|---|
| 570,145 | A | 10/1896 | Pittavino | |
| 726,399 | A | 4/1903 | Burgess | |
| 822,851 | A | 6/1906 | Burgess | |
| 855,439 | A | 6/1907 | Adrianson | |
| 886,211 | A | 4/1908 | Hino et al. | |
| 2,852,880 | A | 9/1958 | Kaufman | |
| 2,865,256 | A | 12/1958 | Marsh | |
| 2,880,543 | A | 4/1959 | Von Frantzius | |
| 3,707,794 | A | 1/1973 | Rocha et al. | |
| 3,736,839 | A | 6/1973 | Childers | |
| 3,824,727 | A | 7/1974 | Hudson | |
| 3,890,880 | A * | 6/1975 | Grandy | 89/1.705 |
| 4,028,994 | A | 6/1977 | Ferluga | |
| 4,061,075 | A | 12/1977 | Smith | |
| 5,123,329 | A | 6/1992 | Irwin | |
| 5,952,601 | A * | 9/1999 | Sanford et al. | 89/1.706 |
| 6,405,631 | B1 * | 6/2002 | Milek | 89/139 |
| 6,490,959 | B2 | 12/2002 | Lavin | |
| 6,761,102 | B2 * | 7/2004 | Giza | 89/194 |

* cited by examiner

*Primary Examiner*—J. Woodrow Eldred

(57) ABSTRACT

A floating barrel gun design, a design in which a propellant gas discharge is used to counterbalance the recoil force of the gun, has been improved to include a novel automatic mechanical mechanism which allows the floating or inner barrel to be held stationary within the gun while the gas is discharged and after the discharge is complete, the barrel is released to return to its pre-actuation position. The discharge of gas is also made safer by an automatic mechanical mechanism for venting the accumulated gas, and this mechanism is activated as the projectile leaves the gun. The mechanism requires that the gas be discharged into the interior of the gun and the recoil-countering gas streams be directed toward a rearward moving breech block. The gas is discharged automatically during the firing cycle, as the firing chamber pressure falls upon the projectile exit, by venting the compressed gas through passageway nozzles which proceed through the annulus of the floating barrel and are controlled by rotatable metal plates. The discharged gas ultimately exits the gun through spaces in the outer barrel which open to the gas as the breech block moves rearward. To explain the invention, the operating of a handgun is described as the preferred embodiment. The handgun is a result of an integration of the ideas concerning a floating barrel delivery system with conventional ballistic designs.

5 Claims, 14 Drawing Sheets

FLOATING BARREL HANDGUN METHOD OF RECOIL ELIMINATION

This invention uses a telescoping or floating barrel delivering system of my invention U.S. Pat. No. 6,490,959 B2 granted 2002 Dec. 10.

BACKGROUND OF THE INVENTION

This invention relates, in general, to a gun and in particular to a gun which uses a telescoping or floating barrel as part of a propellant gas discharge design used to eliminate the gun's recoil.

The floating barrel gun design of U.S. Pat. No. 6,490,959 B2 offered certain advantages over state of the art gun technology. Conventional recoilless guns, using propellant gas discharge to neutralize recoil, were developed in England and Germany during World War II and were used as battlefield artillery weapons. These guns eliminated recoil by discharging propellant gas from nozzles located behind the breech block into the environment in high velocity gas streams as the projectile was accelerated through the barrel. The floating barrel design, by transferring and compressing, before expelling the gas, offered a greater degree of control over the propellant gas and the possibility of higher projectile velocities for a given barrel length. However, as with the preliminary floating barrel design, expelling gas at a high velocity in a rearward direction into the environment created a zone behind the gun which could be very hazardous to personnel nearby and precluded the use of the gun as a close-carry weapon. This specification deals with novel innovations in invention U.S. Pat. No. 6,490,959 B2 which makes possible a recoilless gun with a safer means of discharging the propellant gas used to counter the gun's recoil and may make possible a close-carry recoilless weapon, even a gas discharge operated recoilless handgun.

The previous invention described a prototype gun designed to include two barrels, an internal or floating barrel housing the projectile and an external barrel containing the propellant cartridge. When the porous propellant cartridge fired, part of the firing chamber gas was transferred to a chamber within the gun, which lay between the two concentric barrels, while both the projectile and floating barrel were accelerated forward. The chamber to which the propellant gas was diverted is created by an annulus or ring at the base of the floating barrel and flange at the front of the external barrel. The gas transfer was accomplished by transfer grooves in the wall of the external barrel which extended from adjacently above the base of the floating barrel into the firing chamber. When the floating barrel moved past the region where the grooves ended, the gas flow from the firing chamber terminated and the motion of the floating barrel compressed the gas which accumulated in the chamber. A semi-rigid piston was placed between the propellant charge and the floating barrel/projectile mass in order to increase the efficiency of the gas transfer by delaying the projectile's immediate acceleration until the piston ruptured.

By diverting propellant gas to a chamber within the gun, and then compressing this gas by the forward movement of the floating barrel, the kinetic energy of the moving barrel could be used to raise the pressure of the diverted gas. Raising the pressure of the diverted gas converted firing chamber energy into recoil-countering energy since the compressed gas was expelled through the body of the external barrel in a rearward direction into the environment, stopping the rearward motion of the entire gun. While the gas in the forward chamber was venting, the gas was held in a state of high compression and the floating barrel was prevented from moving rearward during the venting by a gasket which applied frictional force on the internal barrel to hold it in position within the external barrel. This ablative gasket was difficult to automatically manipulate in a mechanical way in repositioning the internal barrel for multiple firings.

The gun was also a prototype with a stationary breech block and had to be disassembled after each firing.

Further research with the basic gun design, determined that the design, if modified to expel the high pressure recoil countering gas within the interior of the gun itself, by positioning the passageway voids through the floating barrel annulus, might be used to produce a recoilless close-carry weapon. If the gas discharge is delayed until the projectile exits the weapon, and the gas is expelled from the forward chamber into the interior of the outer barrel of the gun at the same time or shortly after the breech block of the gun is unlocked from the receiver i.e. external barrel, as in short recoil operated semi-automatic handguns, the gas that is discharged is partially deflected off the unlocked breech block as the breech block is forced to move rearward. The pressure of the expanding gas in the external barrel creates an additional force which is on the base of the floating barrel and which forces the gun in a forward direction. With the external barrel acting as a divergent nozzle, the velocity of the discharged gas can be made to increase substantially and can be used to overcome the inefficiency of the venting process whereby some of the vented gas strikes the breech block and the rear areas of the gun producing a recoiling force.

An object of the present invention is to provide in the floating barrel delivery system an automatic mechanical mechanism for holding the internal and external barrels at the near maximum distance of relative movement within the gun during the firing cycle of the weapon, in order that the recoil-countering gas discharge occurs at a high pressure and, after the gas is discharged, automatically releasing both barrels at the completion of the firing cycle in order that the barrels may be repositioned to their pre-actuation position.

It is another object of this invention to provide in the floating barrel gun design an automatic mechanical mechanism of venting the recoil-countering gas accumulated in the forward chamber into the firing chamber after the projectile has left the gun and in this manner providing a gun which is safe and efficient in overcoming the recoil force.

A further object is to provide a description of how the aforementioned inventions when combined with state of the art ballistic technology can be used to produce a recoilless close-carry weapon.

SUMMARY OF INVENTION

The first invention in the floating barrel design relates to a mechanical means for automatically venting the diverted propellant gas which, upon firing, is accumulated in the forward chamber of the gun. The gas is not vented from the chamber through the external barrel to the outside environment, but rather is discharged through longitudinal nozzles or passageway voids cut through the metal body of the annulus of the internal barrel. The gas is vented in a rearward direction through the floating barrel annulus voids into the firing chamber after the projectile has left the gun. The firing chamber is enclosed by the external barrel which makes the venting much safer.

Upon cartridge ignition, the passageway voids are covered by thick metal plates which are attached to the base of the floating barrel by rotatable hinges and the plates are held firmly against the base of the floating barrel by the force of the firing chamber pressure. In the preferred embodiment, the propellant gas, which is forced to the forward chamber through the transfer grooves has no exit from the chamber except through the passageway voids. After actuation, the floating barrel moves forward compressing the gas trapped within this chamber. After the projectile exits the gun, the firing chamber pressure drops and the forward chamber pressure bearing on the hinged plates through the voids forces the plates to open, discharging the forward chamber gas. Hinged plates are made to swing through an arc of 180 degrees and rest over and significantly close the bore of the floating barrel to the passage of discharged gas. The vented gas escapes the gun through hollow spaces in the rear of the external barrel.

When the gas from the forward chamber is discharged through the voids, the gas pressure of the vented gas streams are high and the gas of the streams further expands in the bore of the of the external barrel. With the bore of the external barrel functioning as a divergent nozzle, the velocity of the gas increases from an already high velocity and an additional force is created on the base of the floating barrel, including the closed bore of the barrel, and this force works to push the gun forward. As this gas escapes the gun through the hollow spaces in the rear of the external barrel, some of the kinetic energy of the gas is transferred to the rear structures of the gun forcing it in a rearward direction, but the design of the gun can be made to minimize this energy transfer.

The second subject of this invention is concerned with a mechanical mechanism that automatically holds the floating barrel near the distance of the barrels maximum forward moment within the external barrel so that the gas in the forward chamber can be vented near the maximum pressure of compression. The mechanism repositions part of the metal wall of the external barrel, moving a metal lever into the bore of the external barrel and obstructing the bore of the barrel during part of the firing cycle. The repositioning of the lever is timed to occur after the floating barrel moves adjacently forward the distal portion of the lever and as the projectile exits and the breech block is unlocked from the external barrel. The moving breech block forces a stud on the rear end of the lever causing the top of the lever to pivot into the external barrel. The obstruction of the bore of the external barrel prevents the floating barrel from returning to its pre-actuation position by the pressure in the forward chamber as the gas is being vented. At the completion of the firing cycle, the lever is automatically returned to its original position in the gun by the action of the returning breech block locking with the external barrel.

The utility of the aforementioned improvements are described in a handgun design using state of the art ballistic mechanical systems to explain how these inventions in the floating barrel design can be used to produce a recoilless close carry weapon.

In some conventional handguns, the breech block is held in place within the gun in order to maintain firing chamber pressure until the projectile exits, then the breech block is unlocked from the receiver and made to move rearward to perform one or more self actuating functions. A modification of a short recoil process for unlocking the breech block from the external barrel when applied to the floating barrel design would not only facilitate the performance of self-actuating functions, but would also aid in increasing the efficiency of the propellant gas venting from the passageway voids since the vented jet streams of gas move through the floating barrel annulus and are directed toward the breech block. With a breech block moving rearward away from the gas streams, less kinetic energy is transferred from the gas streams to the rear of the gun.

A modification of the short recoil operation present in the German Lugar is used to unlock the breech block in the preferred embodiment. The breech block is held in place within the external barrel by a Parabellium-type toggle system and the external barrel is attached to a sliding plate or cradle located on the top of the handle of the gun. After actuation, the external barrel, breech block and toggle system all recoil with the cradle. As these units move rearward and shortly before the projectile leaves the floating barrel, the toggle system is forced out of linear alignment by contact with a stationary sloped surface which is affixed to the handle of the gun. The breech block is then unlocked and is forced by the residual firing chamber pressure to move rearward within the external barrel.

REFERENCE NUMERALS IN DRAWINGS

Figure 1:
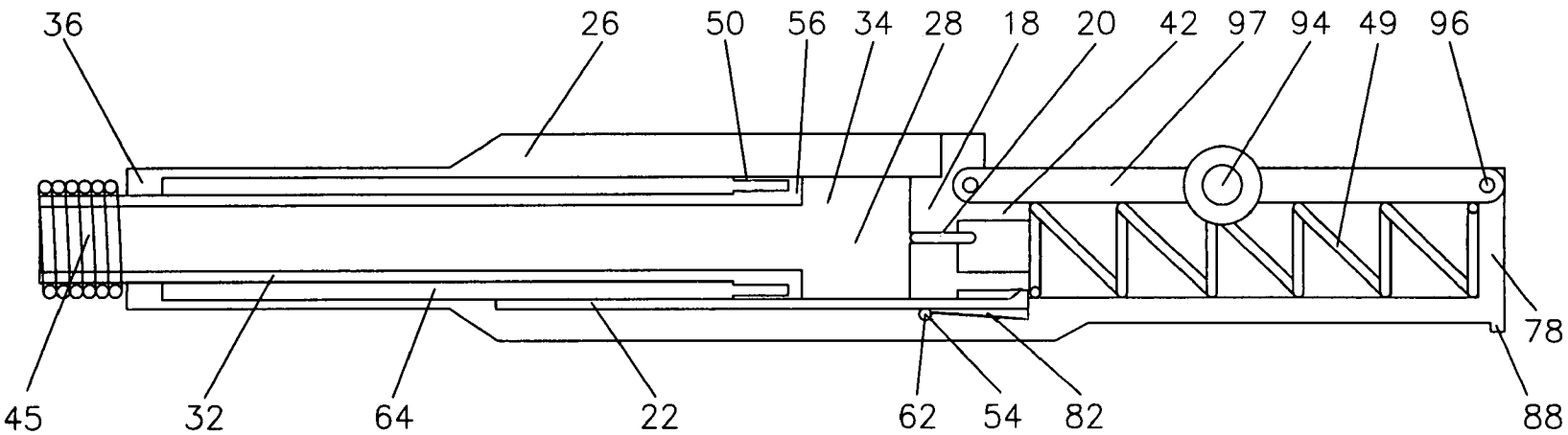
FIG. 1 is a longitudinal cross-sectional view of the delivery system of the gun.
Figure 2:
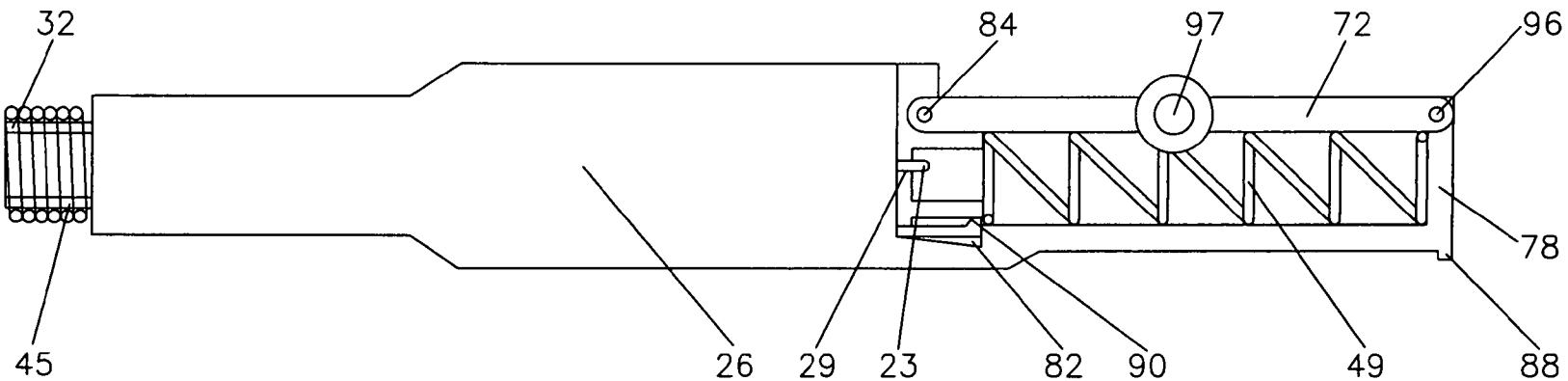
FIG. 2 is a side view of the delivery system of the gun.
Figure 3:
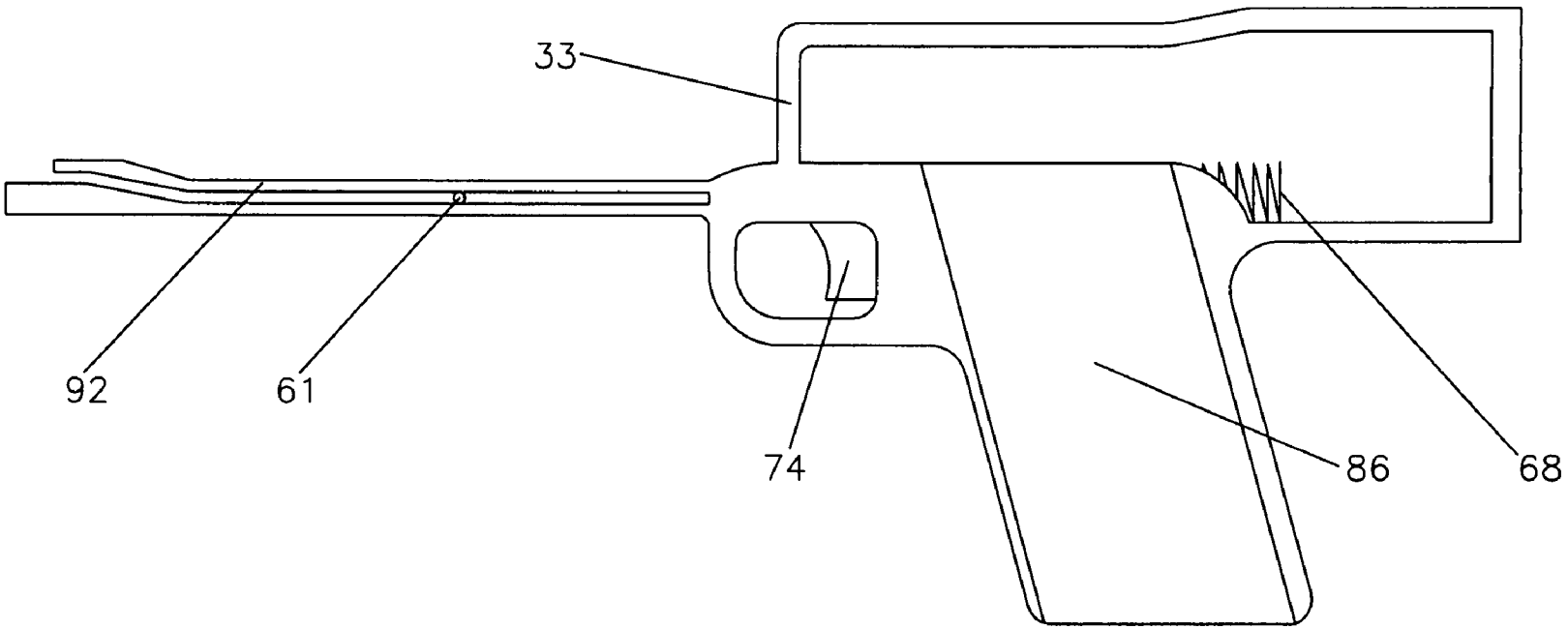
FIG. 3 is a side view of the handle for accommodating the delivery system of the gun.

| Reference Numerals in Drawings | | | |
|---|---|---|---|
| 16 | Cartridge | 18 | Breech Block |
| 20 | Striker Housing | 21 | Rim |
| 22 | Lever (Ex. Bar.) | 23 | Firing Pin |
| 24 | Cavity (Ex. Bar.) | 26 | External Barrel |
| 27 | Bore (In. Bar.) | 28 | Firing Chamber |
| 29 | Aperature | 30 | Projectile |
| 31 | Hinge (In. Bar.) | 32 | Internal or Floating Barrel |
| 33 | Rod (handle) | 34 | Bore (Ex. Bar.) |
| 35 | Pushrod (Ex. Bar.) | 36 | Flange (Ex. Bar.) |
| 38 | Duct (Ex. Bar.) | 39 | Stabilizing Arm (Ex. Bar.) |
| 40 | Hollow (Ex. Bar.) | 42 | Bolt (Breech Block) |
| 43 | Disc (In. Bar.) | 44 | Semi-Rigid Piston |
| 45 | Return Spring | 46 | Transfer Grooves (Ex. Bar.) |
| 48 | Passageway Voids (In. Bar.) | 49 | Compression Spring (Ex. Bar.) |
| 50 | Annulus (In. Bar.) | 52 | Motise (Ex. Bar.) |
| 53 | Shaft (In. Bar.) | 54 | Pin (Ex. Bar.) |
| 55 | Depression (Ex. Bar.) | 56 | Vent Plate (In. Bar.) |
| 58 | Lug (In. Bar.) | 59 | Sleeve (Ex. Bar.) |
| 60 | Notch (In. Bar.) | 61 | Roller Bearing (Handle) |
| 62 | Slanted Holes (Ex. Bar.) | 64 | Forward Chamber |
| 65 | Opening (In. Bar.) | 68 | Spring (Handle) |
| 70 | Knob (Toggle) | 71 | Dowel (In. Bar.) |
| 72 | Bar (Toggle) | 73 | Leaf Spring (In. Bar.) |
| 74 | Trigger | 76 | Thickness (Ex. Bar. Shown at) |
| 78 | Base (Ex. Bar.) | 80 | Hammer |
| 82 | Recess (Ex. Bar.) | 83 | Hole (In. Bar.) |
| 84 | Distal Joint (Toggle) | 85 | Baffle |
| 86 | Handle | 87 | Bludge (In. Bar.) |
| 88 | Slot (Ex. Bar.) | 89 | Tublar (Ex. Bar. Shown at) |
| 90 | Stud (Ex. Bar.) | 91 | Metal (In. Bar. Shown at) |
| 92 | Cradle (Handle) | 93 | Gap (Shown at) |
| 94 | Middle Joint (Toggle) | 95 | Leaf Spring (Shown at) |
| 96 | Proximal Joint (Toggle) | 97 | Toggle |
| 98 | Gap (In. Bar.) | 99 | Primer |

DESCRIPTION OF PREFERRED EMBODIMENT

Figure 6:
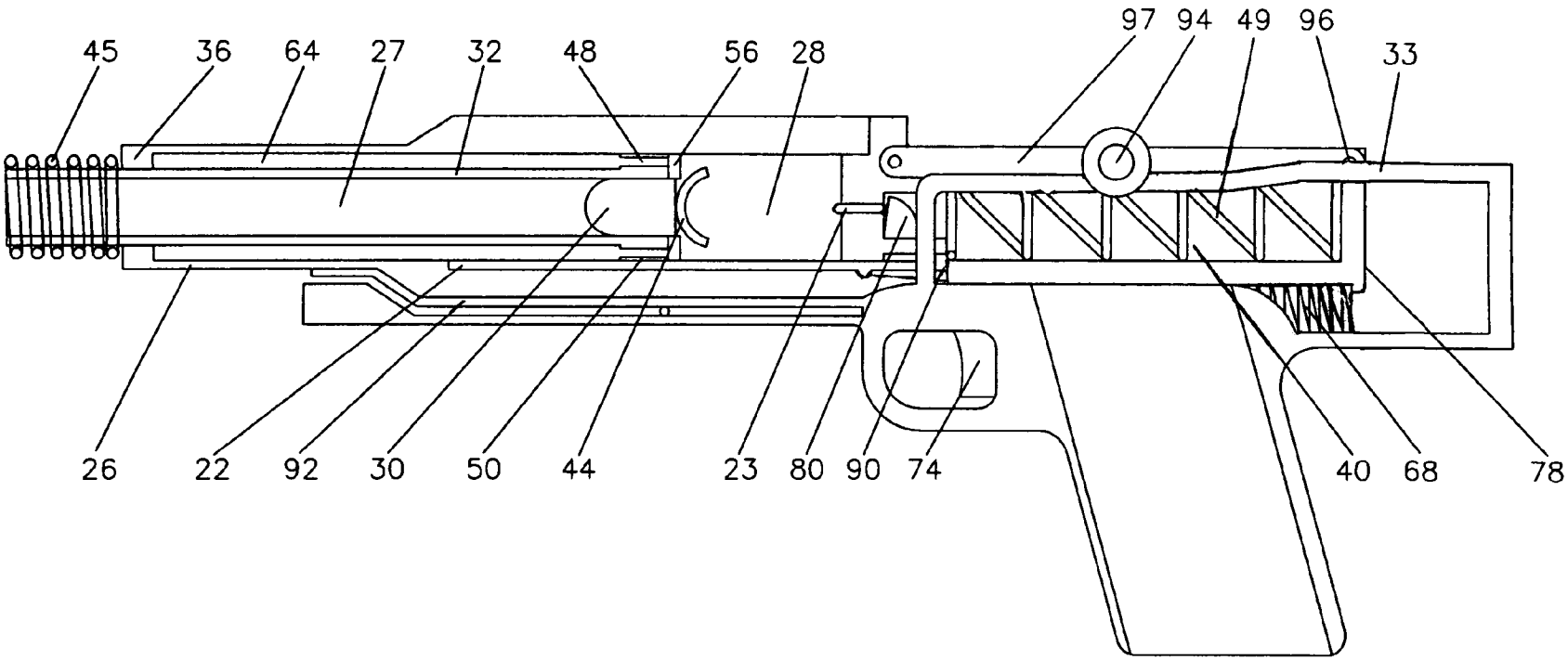
FIG. 6 is a longitudinal cross-sectional view illustrating the operation of the weapon immediately after actuation.
Figure 7:
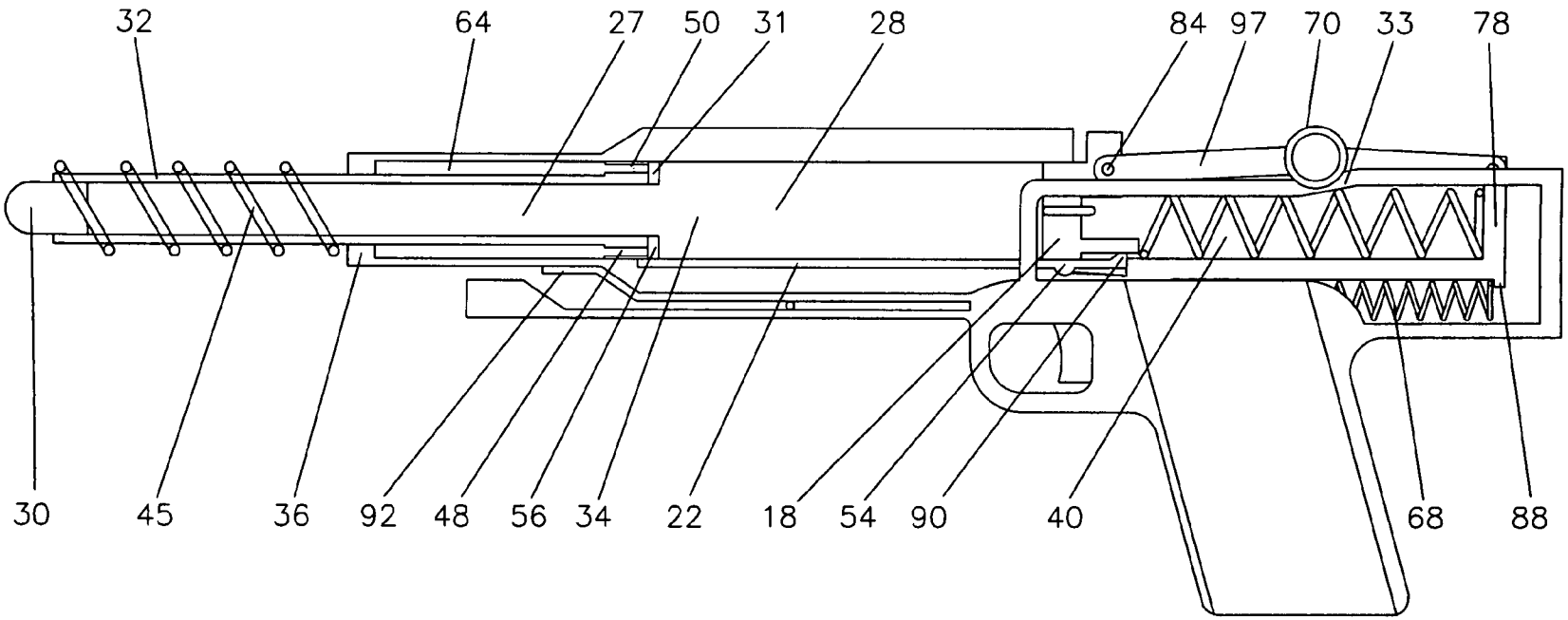
FIG. 7 is a longitudinal cross-sectional view illustrating the operation of the weapon as the projectile exits.
Figure 8:
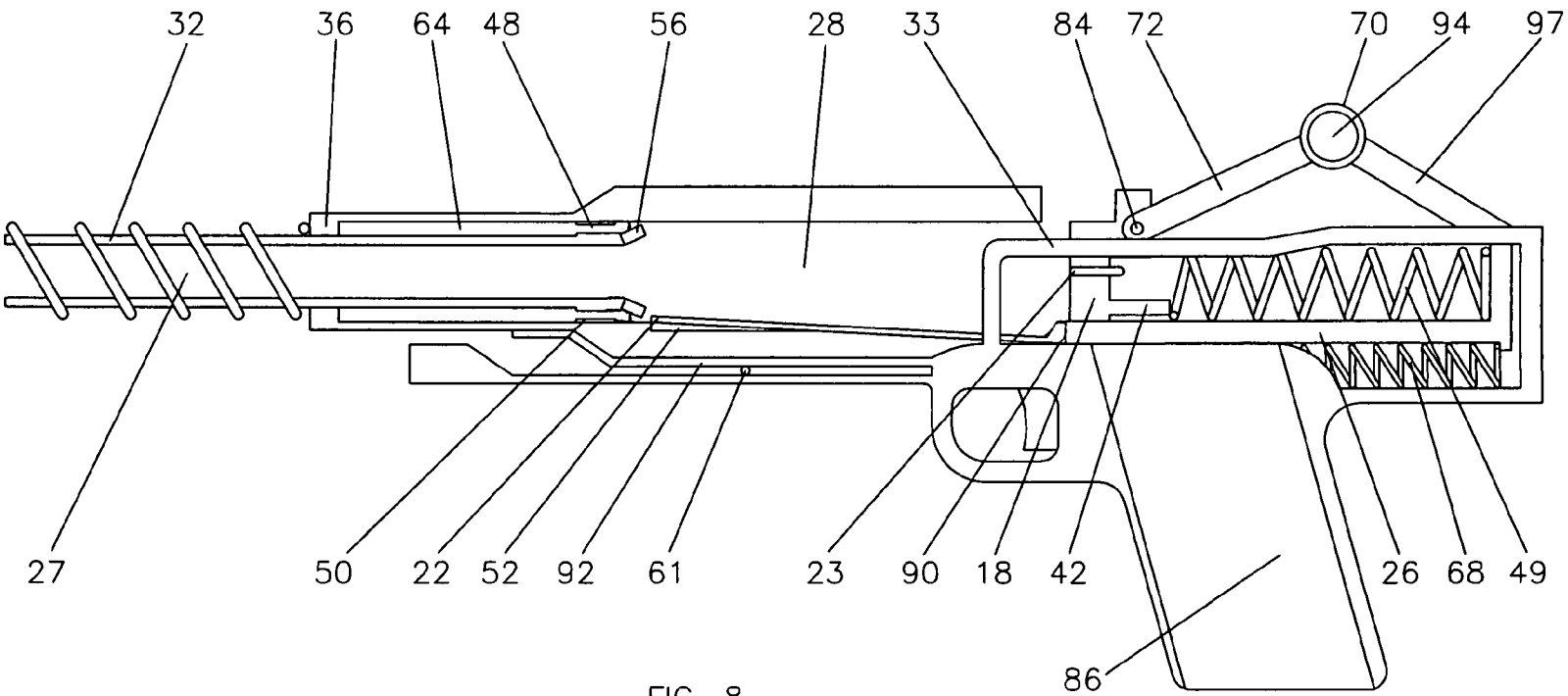
FIG. 8 is a longitudinal cross-sectional view illustrating the operation of the lever, venting plates and toggle system of the weapon during the firing cycle.
Figure 9:
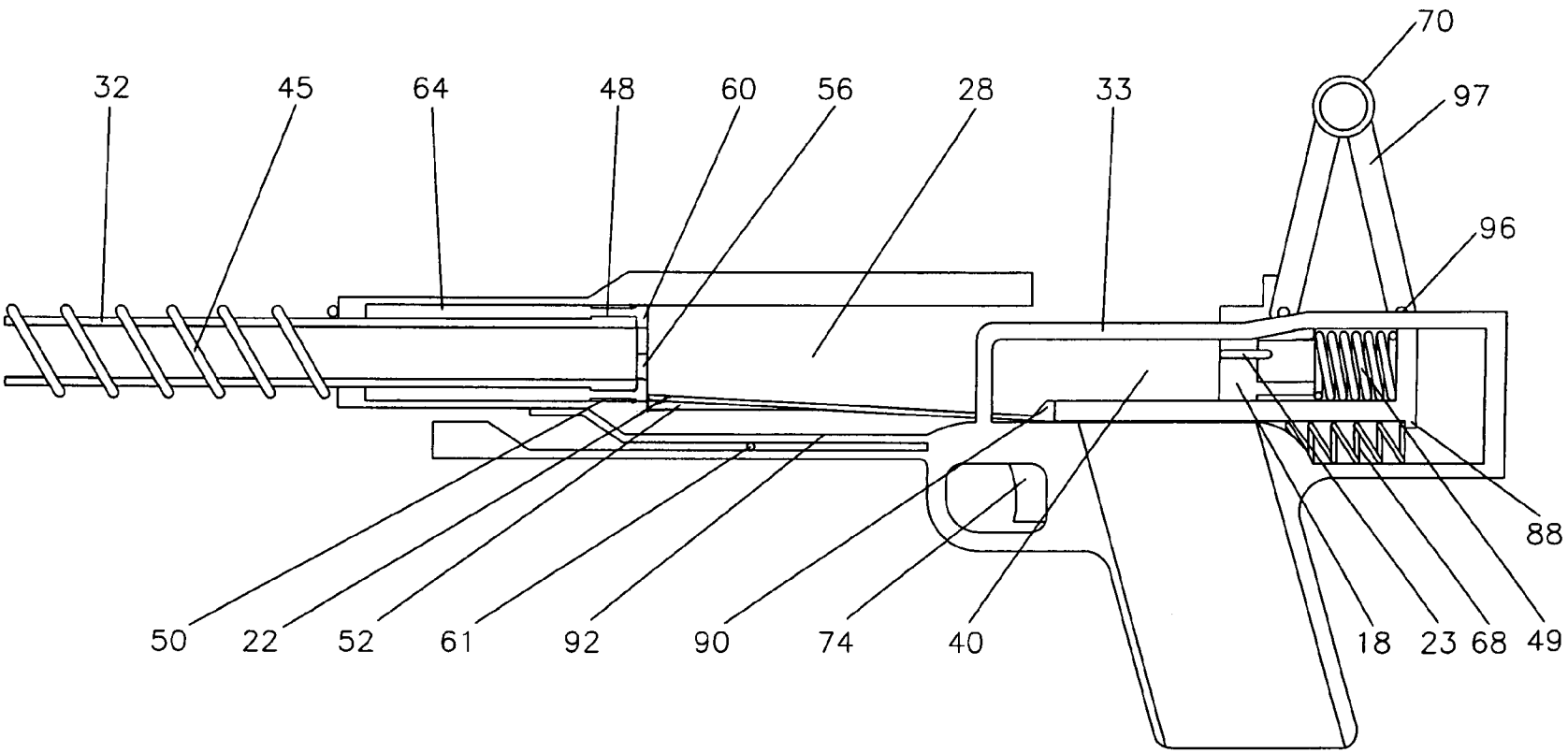
FIG. 9 is a longitudinal cross-sectional view of the weapon at the gas discharge stage in the firing cycle.

The firing mechanism of the gun comprises a forwardly biased longitudinal firing pin (23) slidably mounted in a tubular aperture (29) centrally located in breech block (18). The gun is actuated by manual retraction of trigger (74) causing hammer (80) positioned in handle (86) to move against the action of a spring [not shown]. Hammer (80) (FIG. 6) rises from location in handle (86), moving through an opening in a sliding plate or cradle (92), an opening in external barrel (26) and an opening in the rear of breech block (18), (openings not shown), striking rear end of firing pin (23). Hammer (80) is positioned in handle (86) of gun beneath firing pin (23) to eliminate the need for a long or inertial type firing pin (23).

Trigger (74) is operated by trigger assembly (not shown). Trigger assembly forms no part of subject invention and trigger assemblies comprising a spring, sear and notch are well known in the art and may be positioned in handle (86) so that when trigger (74) is activated by manual retraction, hammer (80) will strike firing pin (23), igniting cartridge (16).

Breech block (18) and striker housing (20) are located within a tubular member of the gun which serves as the external barrel (26). External barrel (26) is a cylinder with bore (34), the internal diameter of which is essentially the same throughout the cylinder. Barrel (26) includes firing chamber (28) adjacently above breech block (18), for seating a cartridge (16), a forward area through which projectile (30) and internal barrel (32) move and a rear area through which breech block (18) moves. External barrel (26) narrows in an internal metal flange (36) at the distal end of bore (34). Adjacently behind breech block (18) some of the tubular metal from the cylindrical body of the barrel (26) is removed to form open spaces or hollows (40) in the structure of barrel (26), leaving only a small metal section of the circumference of barrel (26), which eventually communicates with cradle (92) on handle (86) of gun.

Breech block (18) resides in bore (34) of barrel (26), detached from barrel (26), and capable of sliding rearward to base (78) when unlocked from barrel (26).

Figure 15:
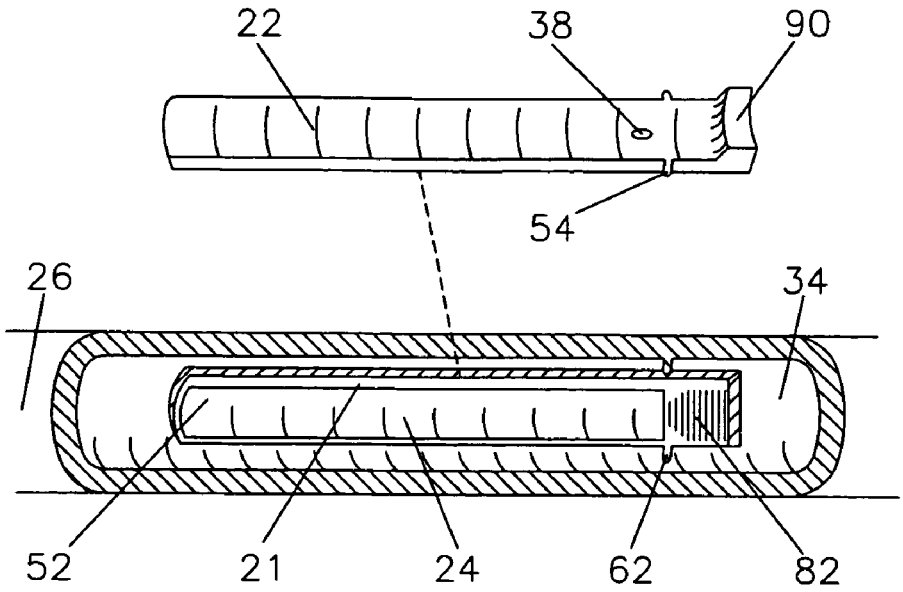
FIG. 15 is a perspective view showing lever and motise of external barrel.

A subject of this invention is a mechanical mechanism for controlling the relative motion of barrels (26), (32) during compression of the diverted gas and this mechanism consists of a rectangular metal block or lever (22) which forms part of the inner wall of external barrel (26), being made to move into bore (34), blocking the rearward movement of barrel (32). Lever (22) movement occurs after floating barrel (32) moves adjacently forward of distal end of lever (22) during firing cycle. Lever (22) is a rectangular metal block detached from external barrel (26) but made to lie within and function as part of barrel (26) during the initial phase of firing cycle. Lever (22), (as shown in FIG. 15) lies in wall of barrel (26) and conforms with curvature of bore (34) on its inward radial side and is flat on outward radial side. Lever (22) extends longitudinally from a distance adjacently under breech block (18) to a distance adjacently forward firing chamber (28). At actuation, lever (22) protrudes into bore (34) only from the location of a slight bludge or stud (90) on the inward rear end, with all other surfaces lying on or below the circumference of bore (34). Lever (22) is held in motise (52), which is formed in barrel (26) to hold lever (22), by pins (54) located on opposite sides of lever (22) which fit into slanted holes (62) on sides of motise (52). Holes (62) and pins (54) are located in an area of lever (22) which is adjacently under breech block (18) (as shown in FIG. 1) The flat metal surface of motise (52) in barrel (26) is further relieved to form a triangular shaped radial recess (82), proximal the location of slanted holes (62), into which the rear end of lever (22) can be forced, causing distal end of lever (22) to rise into bore (34).

Lever (22, as shown in FIG. 15) must have the thickness and strength to resist distortion to its integrity from chambers (28, 64) pressure during the guns operation and lever (22) must be sufficiently rigid to support barrel (32) against pressure in chamber (64) for a short time while gas is being vented. To insure the operation of lever (22) during the firing cycle, a slight amount of metal in the middle of the flat surface of motise (52), located adjacently distal the pre-firing position of breech block (18) is removed to form a cavity (24) which communicates with duct (38) in lever (22) making possible pressure equilibration with gas of firing chamber (28) during operation. Cavity (24) is interposed between lever (22) and surface of motise (52) with rim (21) areas of lever (22) and motise (52) communicating from slightly proximal duct (38) to front end of lever (22).

In drawings, lever (22) is shown at the bottom of the external barrel (26) next to the handle (86) of gun. This is only for illustrative convenience, in reality, lever (22) can be positioned anywhere on the circumference of bore (34) of barrel (26).

Figure 4:
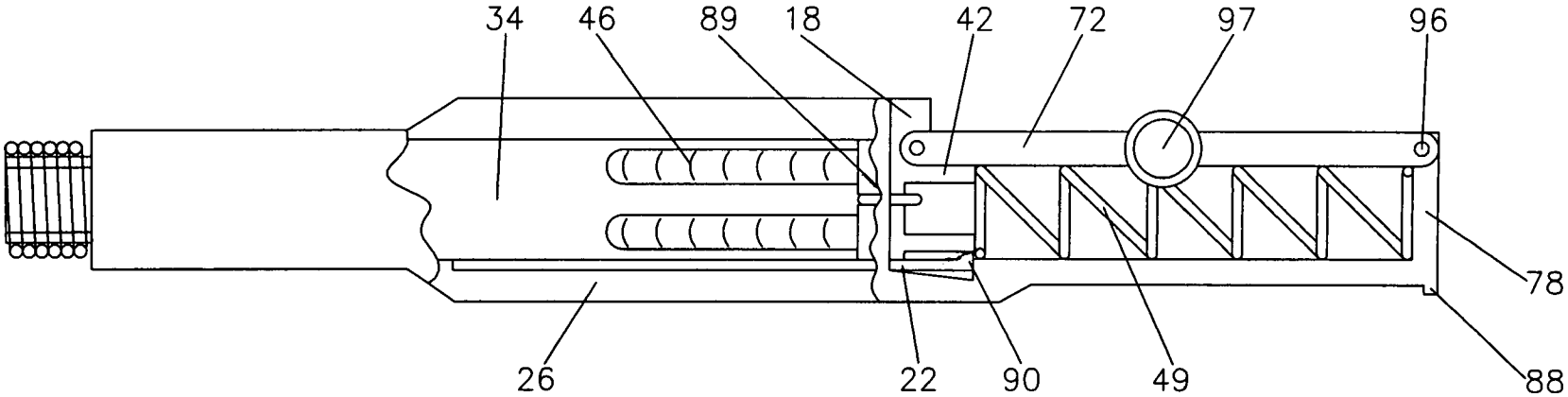
FIG. 4 is a fragmentary, cross-sectional view of the delivery system illustrating the transfer grooves in the inner wall of the external barrel.

Immediately forward breech block (18), a part of the metal in the inner wall of external barrel (26) is relieved along a longitudinal section of bore (34) by the formation of uninterrupted grooves (46, FIG. 4), which extend through firing chamber (28) longitudinally extending forward within the inner metal wall of the barrel (26) to a position lying above firing chamber (28) and adjacently forward the position occupied by annulus (50) of internal barrel (32) when gun is assembled. At a position adjacently distal annulus (50) of internal barrel (32), the axially extending grooves (46) in the internal surface of external barrel (26) end.

Adjacently behind breech block (18), a narrow metal section of the tubular body of external barrel (26) extends longitudinally for a distance, ending by attachment with a circular metal structure forming base (78) of barrel (26) in the rear area of the gun. The narrow section of barrel (26) is securely affixed to cradle (92), which is a thin plate which conforms to the outside dimensions of external barrel (26). Cradle (92) is slidably affixed with roller bearings (61) to the handle (86) of the gun so that cradle (92) may move rearward a distance carrying the floating barrel delivery system before being stopped by most rear area of handle (86). Slot (88) on rear base (78) of external barrel (26) is fastened to expansion spring (68) of handle (86) and spring (68) functions to bias barrel (26) forward at actuation.

Breech block (18) is locked and held in external barrel (26) during firing cycle by a toggle joint system. At actuation, distal joint (84) of toggle (97) is affixed to rear of breech block (18) with knobs (70) of middle joint (94) extending outward on each side of joint (94) and knobs (70) resting on rods (33) which are fixedly secured to handle (86) and run longitudinally along each side of toggle bars (72). Proximal joint (96) is secured to base (78) of external barrel (26). Surface of rods (33) are shaped to gradually slope upward in the area of rod (33) that knobs (70) are pushed to by the recoiling external barrel (26) by the time projectile (30) is about to exit gun.

Rear end of breech block (18) contains two protruding bolts (42) which extend from rear of breech block (18) to communicate with compression spring (49) which extends longitudinally to base (78). Bolts (42, FIG. 1) function to engage compression spring (49) while allowing hammer (80) to strike firing pin (23) when gun is actuated. Spring (49) returns breech block (18) to pre-actuation position after gas discharge in firing cycle is completed.

An expansion spring (45) is placed to lie around the outer distal surface of floating barrel (32) with the distal end of spring (45) fixedly secured to the exterior distal surface of floating barrel (32) and the proximal end of return spring (45) fixedly secured to forward end of external barrel (26). After discharge of the diverted gas, the returning breech block (18) forces lever (22) back into motise (52) and barrels (26, 32), no longer confined by lever (22), are forced to pre-actuation position by return spring (45).

Figure 5:
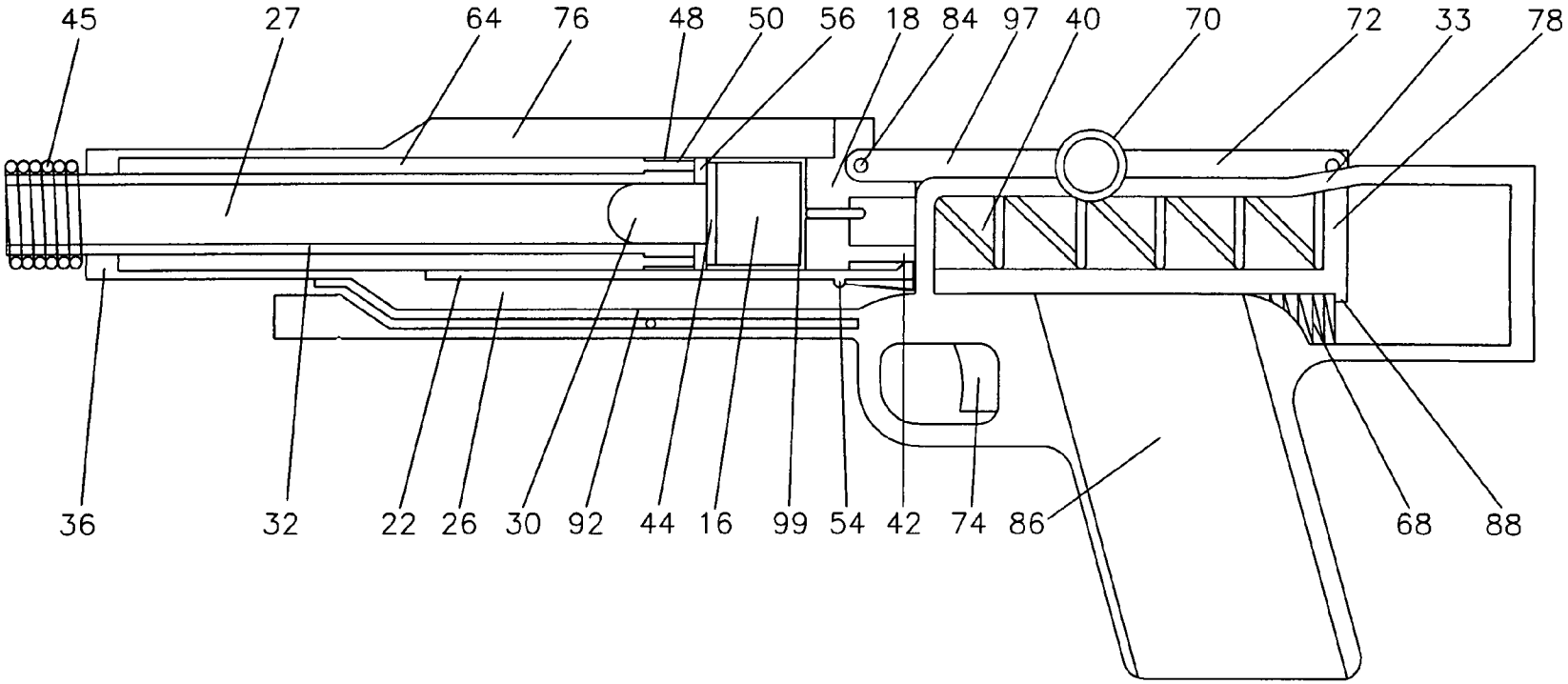
FIG. 5 is a longitudinal cross-sectional view of the assembled weapon.

External barrel (26) is shown (76, FIG. 5) to have a metal thickness larger than most conventional guns. This is due to the necessity of relieving some of barrel's (26) inner metal surface to form transfer grooves (46) and lever (22), so barrel (26) must be reinforced in these areas.

Forward firing chamber (28) in bore (34) of external barrel (26); internal barrel (32) is disposed. Internal barrel (32) is enclosed by external barrel (26) along most of its longitudinal axis and is an elongated cylindrical metal barrel having both ends open and with an unobstructed bore (27). Surrounding the outer metal surface at the proximal end, a metal ring or annulus (50) is fixedly secured to the barrel (32). When disposed within the gun, annulus (50) abuts the rim area of semi-rigid cartridge piston (44) and within bore (27) of internal barrel (32), projectile (30) is enclosed. Annulus (50) communicates circumferently with the interior surface of external barrel (26). The far end of internal barrel (32) is surrounded and supported by internal distal flange (36) and flange (36) is similar in height to annulus (50) of internal barrel (32), so the barrel (32) is supported on its near and far ends by external barrel (26). Internal barrel (32) is free to slide forward, piston-like, moving for a distance within external barrel (26), and extending forward from the front end of the barrel (26), stopping, in design, when annulus (50) meets flange (36).

The internal area in the gun defined by the space between flange (36) of external barrel (26), annulus (50) of internal barrel (32), the interior surface of external barrel (26), and the exterior surface of internal barrel (32) make up an air space within the gun called forward chamber (64). It is into this forward chamber (64) that some propellant gas is directed, upon firing, by means of grooves (46) in external barrel (26).

Figure 10:
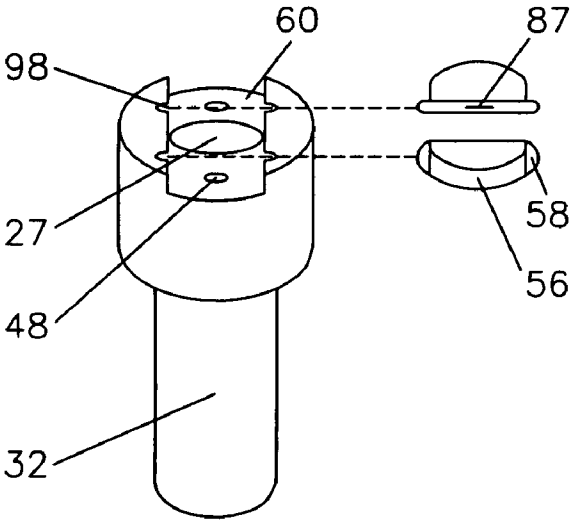
FIG. 10 is a perspective view of the base of the internal barrel showing notch without venting plates.
Figure 14:
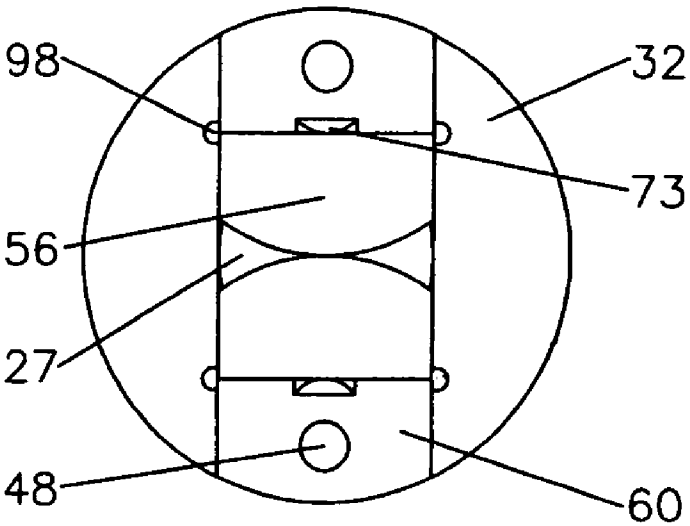
FIG. 14 is a transverse view of base of internal barrel showing venting plates in the open position covering bore of internal barrel.

The power to counteract the rearward thrust imparted to the external barrel (26) from the firing of projectile (30) is supplied by the gas trapped in forward chamber (64) and a mechanism which controls this gas discharge is another subject of this specification. Gas in chamber (64) is expelled through passageway voids (48) which are straight openings proceeding longitudinally from distal side of annulus (50) through metal body of annulus (50) and exiting on proximal base of annulus (50). Voids (48) may also be made to pass through annulus (50) along the longitudinal outer peripheral surface of annulus (50) with the concave inner wall of external barrel (26) used to confine and direct the flow of gas. The metal of floating barrel (32) lying below annulus (50) may also be removed and the space provided used to form voids (48) if the strength of remaining barrel (32) is sufficient to withstand the pressures occurring during the firing cycle. The purpose of voids (48), is to vent the gas from forward chamber (64) into bore (34) toward breech block (18) where the gas streams can expand and be deflected. To control the timing of the gas expulsion, plates (56) are positioned over part of the proximal surface of base of barrel (32) covering voids (48). Plates (56) are part rectangular and part disc in shape, with a metal thickness sufficient to resist distortion at the pressures encountered and are designed to lie in a right angle notch (60, FIG. 10) formed on the base of floating barrel (32).

To accommodate plates (56), the surface at the base of barrel (32) is notched at a right angle for a depth equal to the depth of plates (56). The width of notch (60) is equal to the diameter of bore (27) and the length of each side of notch (60) proceeds parallel across the base of barrel (32) forming a tangent with either side of bore (27) and forming two chords on the circumference of base of barrel (32) and two segments of projecting metal. Plates (56) lie in notch (60) conforming with the circumferential curvature of annulus (50) and then extend inward radially toward bore (27). At actuation, plates (56) lay flat against voids (48) and bottom surface of notch (60), with plate's (56) flat proximal surface communicating with firing chamber (28).

Figure 12:
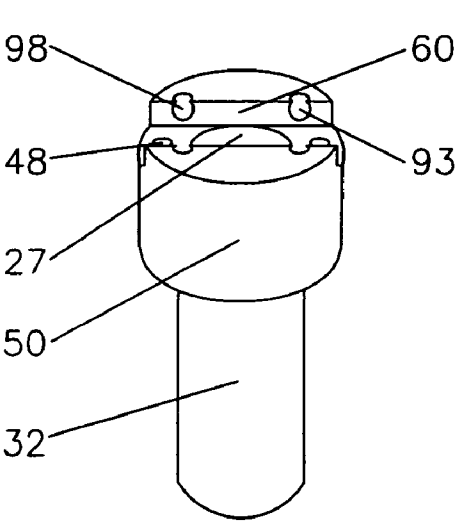
FIG. 12 is a perspective view of the base of the internal barrel showing gaps in notch for holding venting plates.

Preferred embodiment has two passageway voids (48) through annulus (50) and a separate plate (56) covering each void (48). Plates (56) are hinged with two spherical metal lugs (58) on the sides of each plate (56) communicating with notch (60). Lugs (58) are located at the side of plate (56) near bore (27). Lugs (58) fit into spherical gaps (98) in wall of notch (60, FIG. 12). Lugs (58) and gaps (98) act as rotational hinges (31) for plates (56) and allow distal surface of plates (56), which rest within notch (60), covering voids (48), to be rotated radially inward toward firing chamber (28), turning through an arc of 180 degrees so formerly proximal surface of plate (56) then lies distal, significantly covering bore (27) of barrel (32) and with part of the plate (56) surface resting against and communicating with inner metal of barrel (32) which surrounds bore (27, as shown at 91, FIG. 13). The radial extent of each plate (56) and the position of hinges (31) in notch (60) must be predetermined so that the curvature in each plate (56), caused by the curving wall of barrel (26), when rotated through 180 degrees, results in the apex of curvature of these areas almost touching and plates (56) lying flat over bore (27). When plates (56) open and cover bore (27), a substantial portion of bore (27) is closed to gas flow.

In order to facilitate the operation of lugs (58) and gaps (98) in rotating plates (56) for the discharge of chamber (64) gas, the spherical diameter of lugs (58) is quite a bit smaller than the spherical diameter of gaps (98), so that pressure equilibration is attained within these hinges (31) prior to rotation. An opening is also made to each gap (98) in base of barrel (32) to prevent the collapse of barrel's (32) outer metal wall upon lug (58) under high pressure conditions and also to allow pressurized gas to surround lug (58, as shown at 93, FIG. 12). Diameter of lug (58) is larger than the diameter of opening which communicates gap (98) with firing chamber (28), in order to confine lug (58) within gap (98) upon rotation.

Figure 11:
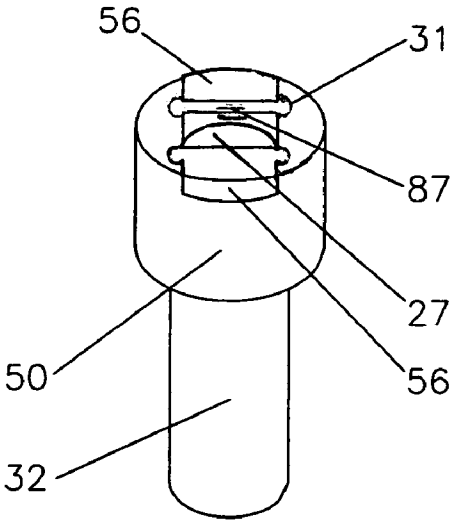
FIG. 11 is a perspective view of the base of the internal barrel with venting plates.
Figure 13:
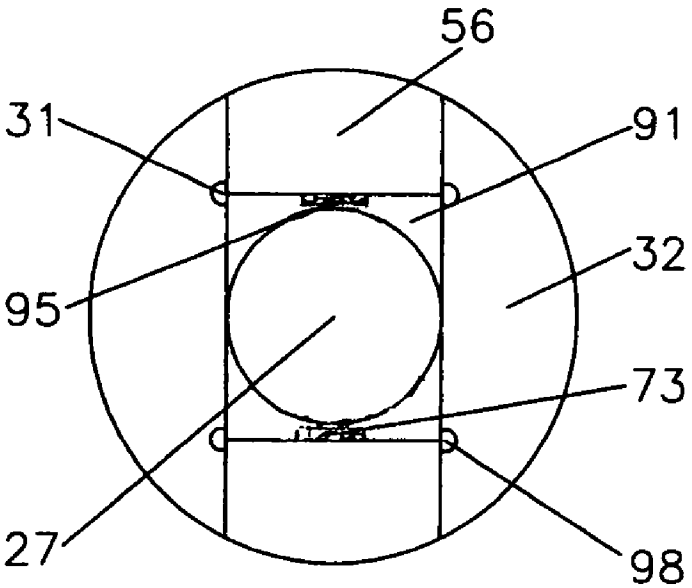
FIG. 13 is a transverse view of the base of the internal barrel showing venting plates covering voids.

Aiding plates (56) to return to their pre-actuation position after firing, a leaf spring (73) can be embedded in internal barrel (32) area, as shown at 95, FIG. 13. Leaf spring (73) is designed to lie embedded in metal surface with its axis of compression facing inward, perpendicular to the longitudinal axis of barrel (32). Bludge (87) on plate (56, FIG. 11) compresses spring (73) as plate (56) rotates approximately 180 degrees, and spring (73) returns plate (56) to its initial position after forces dissipate upon completion of firing cycle.

Cartridge (16) seated in firing chamber (28) in position to be fired by the forward movement of firing pin (23) is of unconventional design and shape. In order to force the propellant gas to accelerate both projectile (30) and internal barrel (32) and also to allow the propellant gas to flow through connecting grooves (46), the diameter of cartridge (16) is larger than that of projectile (30) and is of the approximate diameter of bore (34) of external barrel (26). Cartridge (16) is composed of a material, such as cardboard, which ruptures in the early stage of propellant combustion, or is a metal case with perforations which allow the propellant gas to rapidly diffuse through the case. Since part of the propellant energy is used to accelerate both projectile (30) and internal barrel (32) and part is channeled to forward chamber (64), the amount of smokeless powder contained in cartridge (16) is greater than that contained in conventional cartridges capable of attaining similar projectile velocities. The cartridge (16) is preferably of the type in which a semi-rigid piston (44) is secured within the top rim of cartridge (16) and is actuated by the propellant gas to provide the impact necessary to accelerate both the projectile (30) and internal barrel (32). Semi-rigid piston (44) is a disc composed of a material such as plastic or metal of a predetermined thickness and of a diameter which is slightly smaller than bore (34) of external barrel (26). Because diameter of semi-rigid piston (44) is larger than bore (27) of internal barrel (32), the combustion gasses are prevented from influencing projectile (30) directly until a firing chamber pressure develops that ruptures or bends the piston (44). Semi-rigid piston (44) is then usually expelled from internal barrel (32) following projectile (30). By varying the strength of piston (44), firing chamber (28) pressure and also the pressure of the gasses in forward chamber (64) can be manipulated. The base of the projectile (30) is fixedly secured to the center area of semi-rigid piston (44) prior to ammunition loading.

Figure 16:
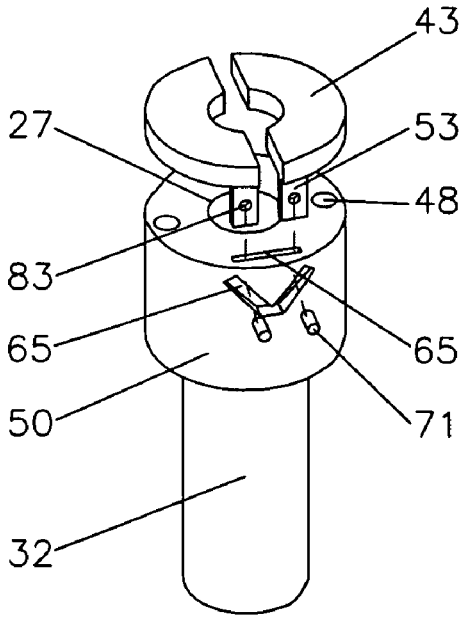
FIG. 16 is a perspective view of base of internal barrel showing an alternative embodiment venting plates.

In an alternative embodiment for discharging the gas accumulated in forward chamber (64), venting discs (43) cover base metal surface of floating barrel (32) and bore (27) remains open (FIG. 16). Each disc (43) covers half of the base of the floating barrel (32) and discs (43) cover voids (48) symmetrically. Because discs (43) have a large surface area communicating with firing chamber (28), the time of their opening can be delayed until firing chamber (28) pressure falls to a low level, allowing breech block (18) to have moved further rearward when the gas is expelled.

Discs (43) lay flat on the base of floating barrel (32) and shafts (53) are securely affixed to sides of each disc (43). Each shaft (53) fits into openings (65) cut into annulus (50) and discs (43) are held in openings (65) by cylindrical dowels (71) which are affixed through holes (83) in shaft (53). Openings (65) are configured in annulus (50) to cause discs (43) to rotate in an arc inward. When dowel (71) moves through hole (83) in shaft (53), disc (43) can be rotated from base of barrel (32) radially inward through an arc of approximately 60 degrees. Designing disc (43) with a restricted arc of 60 degrees insures the proper closure of discs (43) at the completion of firing cycle. When using this method in venting the gas in the forward chamber (64), bore (27) remains open during gas expulsion and the force exerted on the base of barrel (32) by the expanding vented gas within external barrel bore (34) is reduced.

Figure 17:
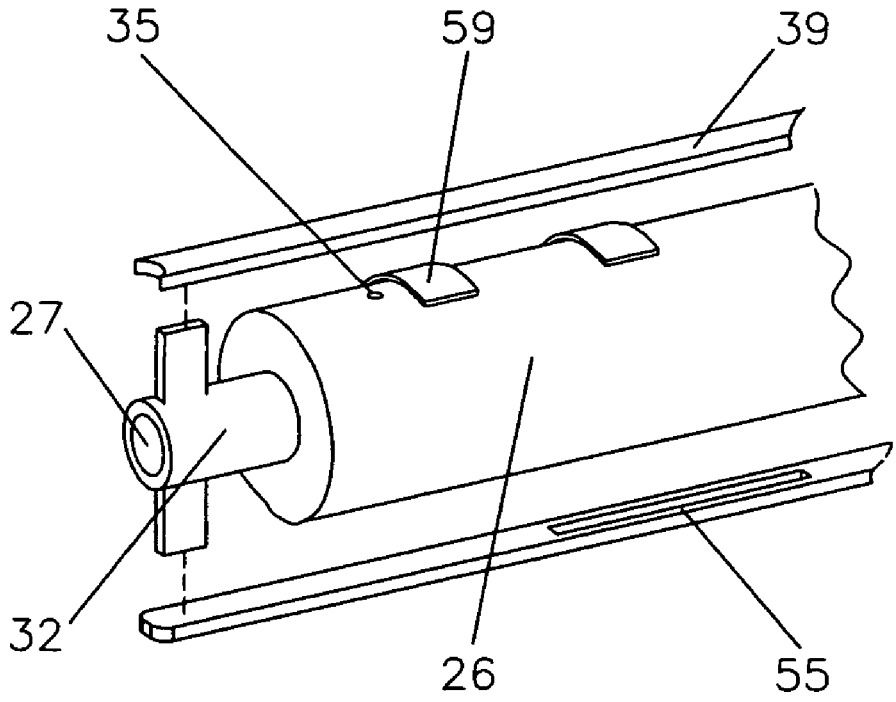
FIG. 17 is a fragmented perspective view showing an alternative embodiment for holding the internal barrel in position during the gas discharge phase of the firing cycle.

An alternative embodiment for locking barrels (26), (32) during gas discharge from forward chamber (64) makes use of a pushrod (35) communicating with the pressure in forward chamber (64) being made to hold barrels (26), (32) immobile (FIG. 17). In this embodiment, stabilizing arms (39) which are elongated solid metal structures, are securely affixed to floating barrel (32) on arms (39) distal end and rest on and conform with the outer surface of external barrel (26), on arms (39) proximal end. Arms (39) are surrounded by guiding sleeves (59) securely affixed to the exterior surface of external barrel (26). Sleeves (59) are located at intervals along barrel (26) and together with surface of barrel (26) surround arms (39) on four sides and permit movement of arms (39) and attached barrel (32) only in a back and forth motion along the longitudinal axis of the gun.

At a predetermined distance on the underside surface of the arms (39) some metal is removed along a central area for a longitudinal distance to form a depression (55) in each arm (39).

Pushrod (35), a cylinder of metal completely detached from barrel (26), but positioned to lie within metal wall of barrel (26), is slightly tapered on its radially far end to prevent pushrod (35) from sliding radially inward from it's position within the wall of barrel (26), adjacent to forward chamber (64), into the center of gun. Pushrod (35) communicates with chamber (64) on radially inward base and with underside of arm (39) on radially outward base. Pushrod (35) can move radially outward when urged by pressure in chamber (64).

The dimensions of depression (55) are slightly larger than the dimensions of the top metal body of pushrod (35), since it is into depression (55) that top portion of pushrod (35) is forced to move by the pressure in forward chamber (64) after internal barrel (32) has moved a distance sufficient to slide depression (55) over top surface of pushrod (35). Pushrod (35) stays in depression (55), holding barrels (26),(32) immobile, as long as the force from chamber (64) is greater than a reversibly directed force on pushrod (35) from a spring i.e. leaf spring (not shown).

Figure 18:
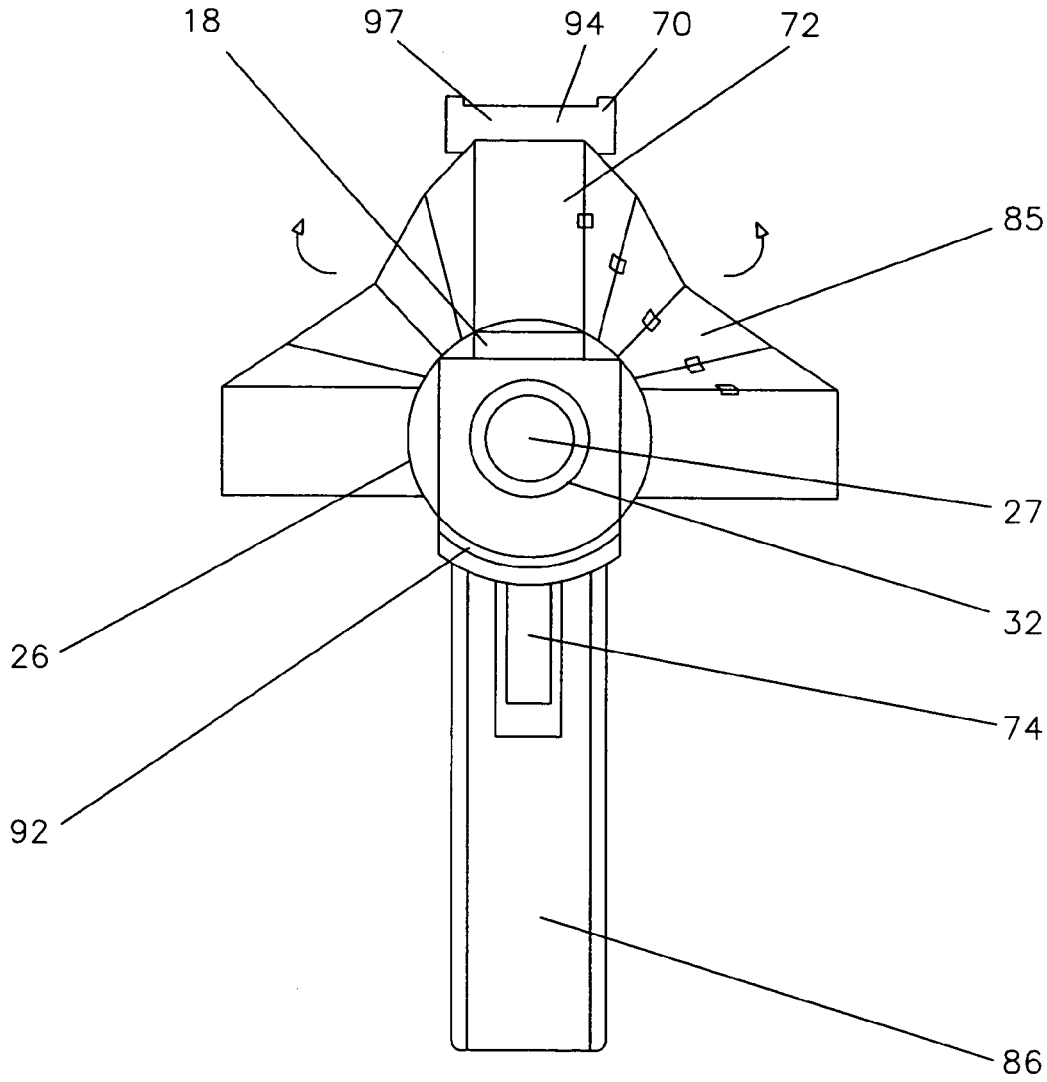
FIG. 18 is a front view of the gun illustrating baffles in the process of opening.

To make the handgun safer for the weapon's operator, the handgun may be equipped with a series of baffles (85). Baffles (85) are folded hinged metal plates affixed to the rear toggle bar (72) on a gun with multiple toggle (97) systems. Baffles (85) would open like an umbrella to shield the operator from high velocity gas as the breech block (18) moves rearward (as shown in FIG. 18). Baffles (85) could be made to do some work that is not translated into recoil as they open, if expansion springs (not shown) are arranged between baffles (85) themselves, to oppose their opening.

Operation of Preferred Embodiment

The main operation of the firing cycle of the invention's preferred embodiment and the order in which the operations are carried out are:

1. Ignition and gas transfer
2. Gas compression
3. Projectile (30) exit and breech block (18) unlocking
4. Floating barrel (32) immobilization
5. Gas discharge The firing of projectile (30) may be accomplished by manual retraction of trigger (74) causing hammer (80), positioned in handle (86), to rise moving through an opening in cradle (92), external barrel (26), and rear of breech block (18), striking rear end of firing pin (23). Firing pin (23) is snapped forward striking primer (99) and firing cartridge (16).

Ignition and Gas Transfer

Cartridge (16) is composed of a material such as cardboard which ruptures in the early stages of smokeless powder oxidation, or is composed of a metal case with perforations for venting the propellant gas generated. Upon cartridge (16) ignition, some of the propellant gas is transferred by transfer grooves (46) in the wall of firing chamber (28) to forward chamber (64) within the gun. The pressure created in the firing chamber (28) starts breech block (18), external barrel (26), and attached toggle (97) system moving rearward. Semi-rigid piston (44), internal barrel (32) and projectile (30) move forward.

External barrel (26) is secured within cradle (92), and cradle (92) with roller bearings (61), is slidably attached to top of handle (86). Cradle (92) allows barrel (26) to move rearward for a distance without movement of handle (86).

To bias external barrel (26) forward at actuation, expansion spring (68) in handle (86) is connected to rear slot (88) of barrel (26) and spring (68) begins expanding after ignition. The movement of breech block (18) and barrel (26) also forces hammer (80) into cocked position within handle (86) of gun.

While barrels (26, 32) are responding to firing chamber (28) pressure, gas is also forced through grooves (46) to forward chamber (64). The number and dimensions of grooves (46) are designed to allow for rapid gas flow from firing chamber (28) to forward chamber (64). The length of grooves (46) are predetermined so that annulus (50) of floating barrel (32) does not move adjacently above the distal end of grooves (46) until a predetermined mass of gas has been transferred to chamber (64). In reduction to practice, the pressure of the mass of gas transferred to chamber (64) is usually nearly equal to the pressure of the gas remaining in the firing chamber (28) and the gas transfer is usually complete as the propellant completes burning.

If, during gas transfer, the pressures in both the firing (28) and forward chambers (64) are equal, there is no accelerative force on the annulus (50) of floating barrel (32) from firing chamber (28) pressure. There is an accelerative force on the actual metal thickness of floating barrel (32) from firing chamber (28) pressure, acting through semi-rigid piston (44), since the distal metal end of barrel (32) is exposed to atmospheric pressure. While semi-rigid piston (44) is intact, firing chamber (28) pressure does not affect projectile (30) directly, but accelerates projectile (30) together with the mass of floating barrel (32).

Semi-rigid piston (44), which impacts the base of projectile (30) and base of internal barrel (32) as the propellant burns, functions to make the gas transfer possible. Semi-rigid piston (44) makes the gas transfer possible in providing extra time for the gas transfer between chambers (28, 64) by delaying the immediate acceleration of projectile (30). While piston (44) is intact, projectile (30) and barrel (32) are being forced forward together and their combined masses together move slower than would projectile (30) moving up floating barrel (32) alone. With piston (44) intact, the burning propellant gas has, in effect, nowhere to go except into forward chamber (64). If the strength of piston (44) is sufficient, the barrel time of projectile (30), i.e. the time projectile (30) remains in gun after propellant ignition, can be very significantly increased above that of conventional guns of similar barrel length and pressure conditions.

Piston (44) also functions to increase the kinetic energy of internal barrel (32), since barrel (32) is under firing chamber (28) force longer by delaying piston's (44) rupture. Although the kinetic energy of barrel (32) is used to ultimately help counter recoil, the gun is most stable with a barrel (32) having moderate kinetic energy levels. In practice, the strength of piston (44) is chosen to delay piston's (44) time of rupture for as long as possible in order to facilitate gas transfer, while keeping the velocity of floating barrel (32) within design parameters of the gun.

After annulus (50) of barrel (32) moves to block the distal end of grooves (46), the gas flow between firing chamber (28) and forward chamber (64) ceases. When this occurs, the gas transferred to forward chamber (64) is trapped in this chamber (64) with no immediate exit.

Gas Compression

Before the gas flow ceases between chambers (28, 64), piston (44) is usually designed to rupture and projectile (30) is exposed to firing chamber (28) pressure and accelerated through barrel (32) as in a normal gun. After piston (44) breaks, it is forced by pressure to follow projectile (30) through floating barrel.

When gas transfer ceases, further movement of barrels (26, 32) cause forward chamber (64) volume to shrink and firing chamber (28) to expand, so gas pressure in chamber (64) increases, while chamber (28) pressure decreases. As barrels' (26, 32) motion continues and projectile (30) moves through barrel (32), the increase in pressure in forward chamber (64), acting on the distal side of annulus (50), starts to overwhelm the force acting on the proximal base of floating barrel (32) and cause barrel (32) to slow and ultimately stop.

The increase of the gas pressure resulting from the compression in forward chamber (64) adds potential energy to the trapped gas and helps correct any loss in gas energy which results from temperature loss during the gas transfer.

Projectile Exit and Breech Block (18) Unlocking

Variables controlling the movement of barrel (32) (i.e. weight, areas of force, etc.) are designed so that barrel (32) is still moving forward in the gun when projectile (30) exits. At the time or shortly before the projectile (30) exits, toggle (97) which holds breech block (18) in place within the rearward moving external barrel (26) is forced from alignment by rod (33) and breech block (18) is unlocked from barrel (26). At actuation, barrel (26) and toggle (97) are in line with knob (70), toggle bars (72), and joints (84, 94, 96) flat down. As barrel (26) moves rearward, knob (70) of middle toggle joint (94) contacts upward sloping surface on rod (33) of handle (86), which cause knob (70) and toggle bars (72) to rise, breaking the longitudinal alignment of toggle (97) and unlocking breech block (18). Residual firing chamber (28) pressure forces breech block (18) rearward and toggle (97) opens as breach block (18) moves. This movement is opposed by a compression spring (49) which stores energy to drive the parts ultimately forward. The weight of breech block (18), toggle (97), and strength of spring (49) are designed to allow them to move rearward quickly. As shown at (89, FIG. 4), breech block (18) has only to move a short distance before encountering hollows (40) in structure of external barrel (26). When breech block (18) moves posteriorly out of tubular part of barrel (26), gas can be vented from external barrel (26) hollows (40) area. Firing chamber (28) pressure at this time is low since projectile (30) has left floating barrel (32). Bottom rear portion of breech block (18) encounters stud (90) of lever (22) and breech block (18) movement forces stud (90) and lever (22) downward into recess (82). Floating barrel (32) is moving forward in barrel (26) at this time, and has moved past distal end of lever (22). Pressure in cavity (24) is equal to any residual firing chamber (28) pressure by communication with duct (38). Proximal end of lever (22) is forced into recess (82) while distal end of lever (22) moves on pins (54) upward into bore (34) of barrel (26) behind the moving floating barrel (32).

When barrel (32) is stopped and forced to move rearward by the difference in pressure between chambers (28, 64), the obstruction of bore (34) by lever (22) prevents barrel (32) from moving appreciably rearward and decreasing pressure of forward chamber (64) gas.

Gas Discharge

After the projectile (30) exits and firing chamber (28) pressure falls, the embodiment of this specification delivers the mass of pressurized gas accumulated in chamber (64) into bore (34) of external barrel (26) through longitudinal passageway voids (48) which proceed through annulus (50) of floating barrel (32). When gun is actuated, venting plates (56) cover voids (48) and are held firmly against base of floating barrel (32) by the force of firing chamber (28) pressure acting on the proximal flat surface of plate (56). The cross-sectional area of each void (48) covered by plate is a small fraction of the total area of base of barrel (32) which is covered by plate (56). Firing chamber (28) pressure has only to be a fraction of the pressure of forward chamber (64) to keep void (48) covered by plate (56). Firing chamber (28) gas follows projectile (30) through internal barrel (32) as the unlocked breech block (18) starts to move from tubular part of external barrel (26). Depending on the amount of compression of the gas in forward chamber (64), the pressure in this chamber (64) is usually high, as high or higher than the peak in firing chamber (28) pressure during propellant burning.

When firing chamber (28) pressure falls, plates swing inward and gas flow through floating barrel (32) forces plates (56) to cover bore (27). To counter recoil, the trapped gas is usually discharged through voids (48) of a cross-sectional area that permits a nozzle exit pressure that is about one-half the initial gas pressure in chamber (64) and in a time that is several times the barrel time of the projectile (30). This results in an initial exit velocity approximately equal to the acoustic velocity at the gas temperature and is capable of exerting a forwardly directed force on the external barrel (26). With breech block (18) open and gas escaping through hollows (40) in barrel (26), the gas pressure in bore (34) of barrel (26) is lower than pressure of discharged gas and gas can further expand and gain velocity as it exits bore (34) through hollows (40). The expansion of the vented gas in bore (34) of barrel (26) imparts an additional force on the base of internal barrel (32) that counters the recoil force on the gun. As the discharged gas exits the gun, some of the high velocity gas strikes breech block (18) and rear structures of the gun forcing the gun in a rearward direction. This energy transfer is not one hundred percent efficient because the gas is forced to expand laterally as it exits the gun. The energy transfer can be further minimized by providing the breech block (18) a long distance of rearward movement. The amount of propellant gas which is transferred to forward chamber (64) and used to counter recoil can be adjusted upward by design to make up for any inefficiency resulting from discharge of gas within the interior of the gun.

The firing cycle of a gun operating with the described inventions can be summarized as follows. At actuation, gas from the burning smokeless powder creates a pressure in firing chamber (28) and at the same time some of the gas is transferred to forward chamber (64) by transfer grooves (46). Floating barrel (32), projectile (30), and semi-rigid piston (44) move forward while the external barrel (26), breech block (18), and toggle (97) system move rearward on cradle (92) in normal recoil. At a predetermined firing chamber (28) pressure, the semi-rigid piston (44) ruptures and projectile (30) begins acceleration through bore (27) of floating barrel (32). After internal (32) and external barrels (26) move a predetermined distance relative to one another, the flow of propellant gas to forward chamber (64) ceases. Further movement of barrels (26, 32) cause the pressure of the gas in forward chamber (64) to rise and firing chamber (28) pressure to fall as projectile (30) is accelerated through floating barrel (32). The recoiling toggle (97) system loses linear alignment upon contact with a sloped surface affixed to the gun's handle (86) and breech block (18) unlocks from external barrel (26) and projectile (30) exits gun with the residual firing chamber (28) gas. Breech block (18) quickly moves out of the tubular enclosed part of external barrel (26) and forces lever (22) to move into bore (34) of external barrel (26) blocking bore (34) of external barrel (26) behind the position of floating barrel (32). Responding to the low firing chamber (28) pressure, plates (56) rotate inward and substantially block the bore (27) of floating barrel (32) and forward chamber (64) gas begins to vent from voids (48). The exiting of the gas in a rearward direction exerts a force on barrel (26) pushing the gun in a forward direction. Preferably, the cross-sectional area of voids (48) are kept small, so when gas is vented, the gas still has a substantial pressure upon exit. The time of venting of the gas can encompass several milliseconds. Venting of the gas in this manner allows the forward motion of floating barrel (32) to be halted by the residual gas remaining in forward chamber (64) as the gas is being vented and also allows the vented gas more time to expand through hollows (40) in barrel (26). When the forward motion of floating barrel (32) is stopped, barrel (32) is forced to move rearward with the rest of the gun due to the greater momentum of the recoiling external barrel (26).

As the gas exits from voids (48), the pressure of the exiting gas is preferably high and with bore (27) of floating barrel (32) substantially closed and breech block (18) open, the gas further expands within bore (34) of external barrel (26). This expansion creates another forwardly directed force on the base of floating barrel (32) before leaving through hollows (40) in external barrel (26). The weapon can be designed so that as the gas is vented, the recoiling gun can move rearward upon the sliding cradle (92) while the rate of its rearward velocity decreases as the gas is vented.

After the gas is expelled, spring (49) urges breech block (18) and returning breech block (18) forces lever (22) from recess (82), so barrels (26,32) are no longer immobilized. The handgun is returned to its pre-actuation position by return spring (45) surrounding floating barrel (32) located at the front of the handgun.

The forgoing disclosure and description of the invention is illustrative only. Various changes may be made within the scope of the appended claims without departing from the spirit of the invention.

I claim:

1. A gun for directing a projectile, said gun compromising:

(a) an external barrel having an inner wall forming a hollow interior within said external barrel, said external barrel having a forward end and having a rear end; said external barrel having an internal metal flange extending into said hollow interior and causing said hollow interior of said external barrel to have a narrowed internal diameter thereat; said internal flange having a proximal side remote from said forward end; said external barrel being terminated at said rear end by a metal base extending into said hollow interior; said external barrel containing a detached breech block with a striker housing aperture therethrough; said hollow interior having a firing chamber portion distally adjacent said breech block, said firing chamber portion being adapted for holding a firing cartridge therewithin;

(b) a forwardly-slidable internal barrel disposed within said external barrel, said internal barrel being an elongated cylinder of metal having an outer surface and having a distal end and having a proximal end; said internal barrel being open on said distal end and on said proximal end and having an unobstructed bore extending therethrough from said distal end to said proximal end; said internal barrel including an external metal annulus secured thereabout adjacent said proximal end, said annulus having a distal side remote from said proximal end; said distal end of said internal barrel being supported and surrounded by said internal flange of said external barrel;

said gun having a forward chamber therewithin bounded by said distal side of said annulus of said internal barrel, by said proximal side of said internal flange of said external barrel, by said outer surface of said internal barrel, and by said inner wall of said external barrel;

said gun further having at least one concave groove formed within said internal wall of said external barrel and extending longitudinally from within said firing chamber, past said annulus of said internal barrel, and to said forward chamber;

said gun further having at least one passageway void disposed though said metal annulus of said internal barrel; said passageway void having a first opening through said distal side of said annulus and a rearwardly-facing second opening through said proximal side of said annulus.

2. The gun as recited in claim 1, wherein said gun further has a pivotable lever disposed within said inner wall of said external barrel; said lever having a forward end and having a rear end; said lever extending from the location adjacent said breech block at said rear end of said lever longitudinally to the location adjacent said forward chamber at said forward end of said lever; said lever further having a stud on said rear end, said stud of said lever protrudes into said hollow interior of said external barrel; said lever on said rear end being insertable into a further recess in said inner wall of said external barrel, whereby at the urging of said stud, said rear end of said lever moves into said recess thereby pivoting said forward end of said lever into said hollow interior of said external barrel.

3. A gun for directing a projectile, said gun compromising:

(a) an external barrel having an inner wall forming a hollow interior within said external barrel, said external barrel having a forward end and having a rear end; said external barrel having an internal metal flange extending into said hollow interior and causing said hollow interior of said external barrel to have a narrowed internal diameter thereat; said internal flange having a proximal side remote from said forward end; said external barrel being terminated at said rear end by a metal base extending into said hollow interior; said external barrel containing a detached breech block with a striker housing aperture therethrough; said hollow interior having a firing chamber portion distally adjacent said breech block, said firing chamber portion being adapted for holding a firing cartridge therewith in;

(b) a forwardly-slidable internal barrel disposed within said external barrel, said internal barrel being an elongated cylinder of metal having an outer surface and having a distal end and having a proximal end; said internal barrel being open on said distal end and on said proximal end and having an unobstructed bore extending therethrough from said distal end to said proximal end; said internal barrel including an external metal annulus secured thereabout adjacent said proximal end, said annulus having a distal side remote from said proximal end; said distal end of said internal barrel being supported and surrounded by said internal flange of said external barrel;

said gun having a forward chamber therewithin bounded by said distal side of said annulus of said internal barrel, by said proximal side of said internal flange of said external barrel, by said outer surface of said internal barrel, and by said inner wall of said external barrel;

said gun further having at least one concave groove formed within said internal wall of said external barrel and extending longitudinally from within said firing chamber, past said annulus of said internal barrel, and to said forward chamber;

said gun further having a plurality of passageway voids disposed though said metal annulus of said internal barrel; said passageway voids having a first opening through said distal side of said annulus and rearwardly-facing second opening through said proximal side of said annulus;

said gun further having immobilization means for preventing reciprocation of said internal barrel and said external barrel during firing cycle;

said gun further having automatic discharge means for venting of gas from said forward chamber.

4. The gun as recited in claim 3, wherein said immobilization means for preventing reciprocation of said internal barrel and said external barrel during said firing cycle includes a plurality of pushrods disposed radially through metal body of said external barrel; said pushrods having a radial inward side remote from a radial outward side; said pushrods communicating with said forward chamber on said radial inward side; said pushrods on said radial outward side being insertable into depression on the underside of arm affixed to said internal barrel so that when said pushrods are urged radially outward by pressure in said forward chamber into said depression in said arm, said reciprocal movement of said internal barrel and said external barrel is opposed by the engagement of said pushrods with the surface located distally adjacent said depression on said arm of said internal barrel.

5. The gun as recited in claim 3, whereby said automatic discharge means for venting said gas from said forward chamber includes metal plates disposed to lie across the proximal base of said internal barrel enclosed within a notch in said base of said internal barrel, said notch extending within and transversing said base of said internal barrel; said plates having a distal side and having a proximal side; each said plate covering and communicating with a said passageway void on said distal side; said plates communicating with said forward chamber on said proximal side; said plates having a radially inward side and having a radially outward side; said plates are laterally hinged near said radially inward side and rotatably affixed to inner wall of said notch so that when forced by pressure in said passageway voids, said plates rotate through one hundred eighty degrees to lie over and significantly cover said bore of said internal barrel.

* * * * *